US009228551B2

(12) United States Patent
Gerstner

(10) Patent No.: US 9,228,551 B2
(45) Date of Patent: Jan. 5, 2016

(54) QUILL TUBE PROTECTION FEATURE

(75) Inventor: Michael D. Gerstner, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 617 days.

(21) Appl. No.: 13/614,241

(22) Filed: Sep. 13, 2012

(65) Prior Publication Data

US 2014/0069388 A1 Mar. 13, 2014

(51) Int. Cl.
*F02M 55/02* (2006.01)
*F02M 55/00* (2006.01)

(52) U.S. Cl.
CPC ..... *F02M 55/02* (2013.01); *F02M 55/005* (2013.01)

(58) Field of Classification Search
CPC ..... F02M 61/14; F02M 55/025; F02M 55/02; F02M 55/005; F02M 2200/856
USPC ..... 123/468, 469, 470, 304, 456, 514, 123/198 D; 285/123, 123.1, 123.2, 123.3, 285/123.15, 120.1, 124.1
See application file for complete search history.

(56) References Cited

U.S. PATENT DOCUMENTS

| | | | | |
|---|---|---|---|---|
| 3,845,748 | A * | 11/1974 | Eisenberg | 123/468 |
| 6,279,540 | B1 * | 8/2001 | Greaney et al. | 123/470 |
| 6,840,283 | B2 | 1/2005 | Furugen et al. | |
| 7,134,698 | B2 | 11/2006 | Neumaier | |
| 7,543,567 | B2 * | 6/2009 | Gibson et al. | 123/456 |
| 2009/0139595 | A1 * | 6/2009 | Kato et al. | 138/109 |
| 2009/0151701 | A1 * | 6/2009 | Kato et al. | 123/470 |
| 2011/0174272 | A1 * | 7/2011 | Male | 123/469 |
| 2012/0006299 | A1 * | 1/2012 | Worthington et al. | 123/469 |
| 2012/0012083 | A1 * | 1/2012 | Tower et al. | 123/468 |
| 2012/0279475 | A1 * | 11/2012 | Guido et al. | 123/468 |
| 2012/0291752 | A1 * | 11/2012 | Hackett | 123/445 |
| 2013/0048750 | A1 * | 2/2013 | Kim et al. | 239/11 |
| 2013/0056978 | A1 * | 3/2013 | Swift et al. | 285/332 |

FOREIGN PATENT DOCUMENTS

WO WO 2012098087 A1 * 7/2012

* cited by examiner

*Primary Examiner* — Hai Huynh
*Assistant Examiner* — Raza Najmuddin
(74) *Attorney, Agent, or Firm* — Miller, Matthias & Hull LLP

(57) ABSTRACT

A quill tube is provided. The quill tube includes a hollow body and a spherical head. The hollow body defines a bore within the quill tube. The bore is configured to direct a flow of fuel into a fuel injector. The spherical head is located at a first end of the hollow body. The spherical head includes a tip, a first surface and a second surface. The tip is located at a distal end of the spherical head. The first surface is configured to engage with the fuel injector. The second surface is positioned between the tip and the first surface. Further, a flange is located proximate to the spherical head. The flange is angularly positioned relative to the first surface. If the spherical head is contacted against an external surface, the flange is configured to cause the second surface to touch the external surface.

9 Claims, 5 Drawing Sheets

QUILL TUBE PROTECTION FEATURE

TECHNICAL FIELD

The present disclosure relates to fuel delivery systems for an engine, and more particularly to quill tubes in the fuel delivery system.

BACKGROUND

Quill tubes are typically used to deliver fuel to multiple fuel injectors present within an engine. For example, U.S. Pat. No. 6,840,283 relates to a high-pressure fuel injection pipe having a connecting head portion which is capable of preventing occurrence of cavitation erosion of an inner surface of the connecting head portion by having a contour of a cross section of an annular pocket occurring in an inner part of the connecting head portion. The fuel injection pipe has a connecting end portion of a thick-walled steel pipe, a seat surface, an annular flange formed so that the flange is axially spaced from the seat surface, and a conical surface connected to the seat surface, extending therefrom to the annular flange and tapering off to a free end of the connecting head portion.

SUMMARY OF THE DISCLOSURE

In one aspect of the present disclosure a quill tube for a fuel delivery system is provided. The quill tube includes a hollow body and a spherical head. The hollow body defines a bore within the quill tube. The bore is configured to direct a flow of fuel into a fuel injector. The spherical head is located at a first end of the hollow body. The spherical head includes a tip, a first surface and a second surface. The tip is located at a distal end of the spherical head. The first surface is configured to engage with the fuel injector. The second surface is positioned between the tip and the first surface. Further, a flange is located proximate to the spherical head. The flange is angularly positioned relative to the first surface. If the spherical head is contacted against an external surface, the flange is configured to cause the second surface to touch the external surface.

Other features and aspects of this disclosure will be apparent from the following description and the accompanying drawings.

DETAILED DESCRIPTION

Figure 1:
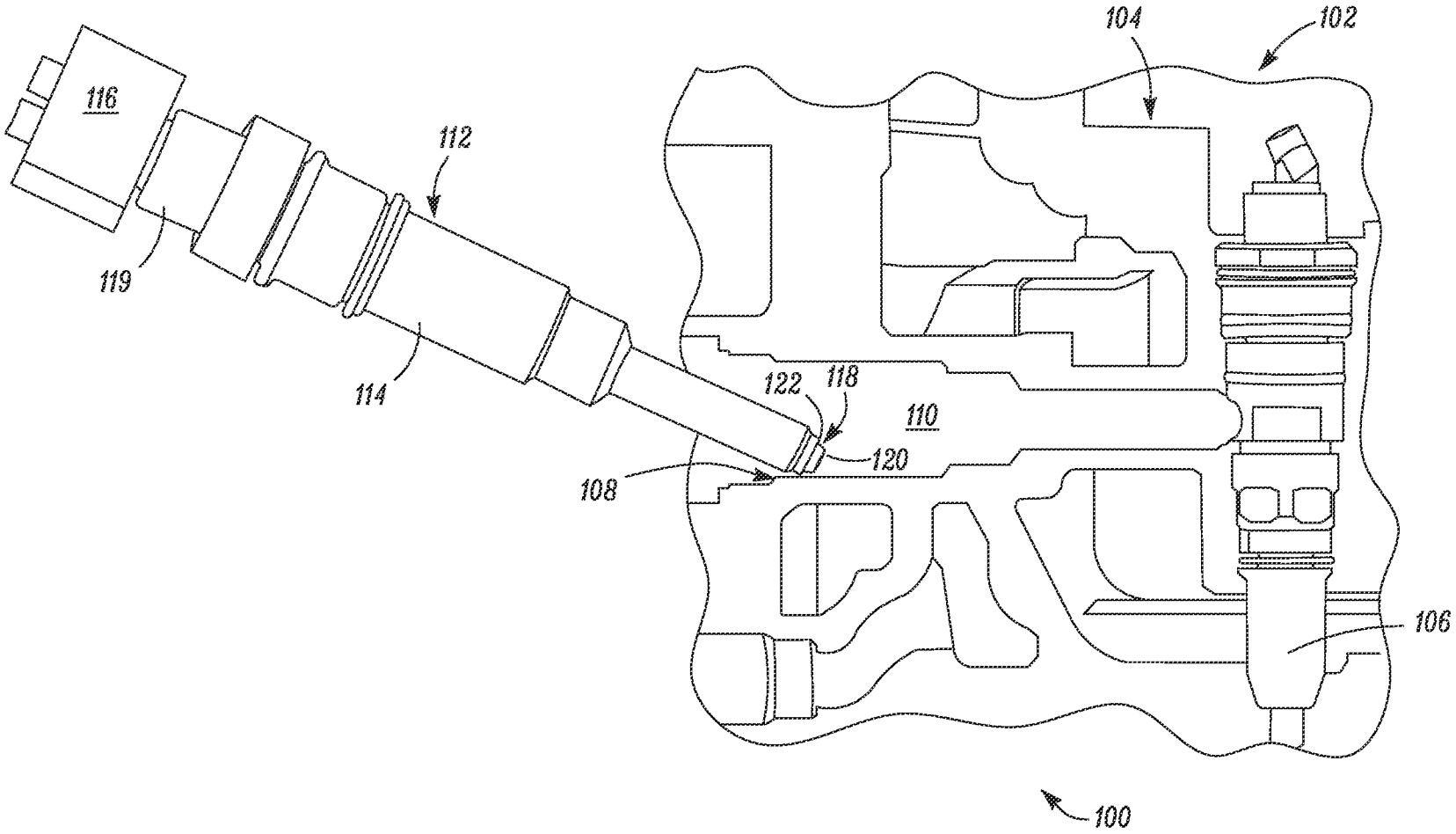
FIG. 1 is an exemplary fuel delivery system including a cross sectional view of an engine, according to one embodiment of the present disclosure.

FIG. 1 illustrates an exemplary fuel delivery system 100 having a cross-sectional view of an engine 102. The engine 102 may be provided in various types of machines such as, for example, a fixed or mobile machine that performs some type of operation associated with an industry such as mining, construction, farming, transportation, power generation, tree harvesting, forestry, or any other industry known in the art.

Further, the engine 102 may be an internal combustion engine or any other engine apparent to one skilled in the art such as, for example, a diesel engine, a gasoline engine, a gaseous fuel powered engine, or any other type of engine apparent to one skilled in the art. The engine 102 may include a cylinder head 104 having one or more cylinders (not shown) formed therein, each with a piston in a combustion chamber associated therewith as known in the art. The fuel delivery system 100 may additionally include components such as, for example, a fuel tank, a high pressure pump, and/or a common rail.

The common rail may supply fuel at a relatively high pressure to one or more fuel injectors 106 disposed in the cylinder head 104. Each of the fuel injectors 106 may be associated with a respective cylinder head 104. The fuel injector 106 may include a securing member (not shown). The fuel injector 106 may be operable to inject an amount of pressurized fuel into the associated combustion chamber in the cylinder head 104 at predetermined times, fuel pressures, and fuel flow rates as known in the art.

Referring to FIG. 1, the cylinder head 104 may include an inner surface 108 defining a cavity 110. The cavity 110 may be configured to house a quill tube 112. The fuel injector 106 may be housed at a distal end of the cavity 110. Further, the quill tube 112 may be configured to move in an axial direction within the cavity 110, to engage with the fuel injector 106. On installation of the quill tube 112, a high pressure fuel, e.g., from the high pressure pump and/or the common rail, may be supplied to the fuel injector 106. It should be noted that the fuel delivery system 100 shown in FIG. 1 is merely on an exemplary basis. The fuel delivery system 100 may additionally include other components not described herein.

Figure 2:
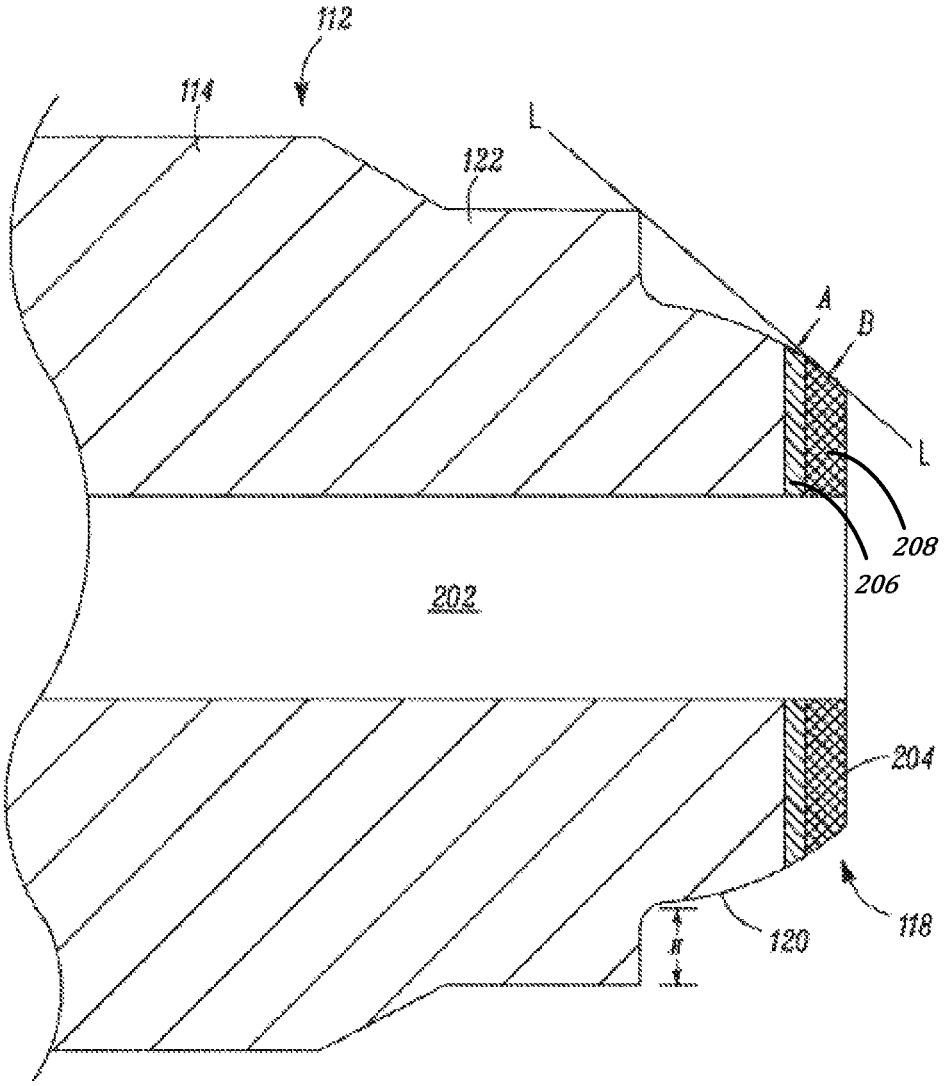
FIG. 2 is an cross sectional view of a portion of the a quill tube.

As shown in accompanied figures, the quill tube 112 may include a hollow body 114, defining a bore 202 (see FIG. 2). The bore 202 is configured to receive a supply of the fuel from an inlet end 116 and direct it towards a first end 118 of the quill tube 112. The quill tube 112 may also include a clamp 119. As shown in FIG. 1, the quill tube 112 may include a spherical head 120 located at the first end 118 of the hollow body 114. A tip 204 (see FIG. 2) may be located at a distal end of the spherical head 120. Further, when installed, a first surface 206 of the spherical head 120 is configured to engage with the fuel injector 106.

The first surface 206 is represented as a band in FIG. 2 and may include a plurality of sealing locations, one of which is depicted as a point A. At the point A, the quill tube 112 may contact with a conical shaped cavity within the fuel injector 106. It should be noted that during installation of the quill tube 112, the spherical head 120 of the quill tube 112 may be contacted against any external surface LL having a flat configuration, for example, but not limited to, the inner surface 108 of the cylinder head 104.

The present disclosure relates to providing a flange 122 proximate to the spherical head 120 of the quill tube 112. Referring to FIG. 2, the flange 122 may be angularly positioned relative to the first surface 206. When the spherical head 120 of the quill tube 112 is contacted against the external surface LL, the flange 122 may be configured to cause a surface lying between the first surface 206 and the tip 204, namely a second surface 208, to touch the external surface LL. The second surface 208 is represented as a band adjacent to the first surface 206 in FIG. 2. The second surface 208 may include a plurality of damage location points, one of which is denoted as a point B, at which the second surface 208 may contact the external surface LL. It should be understood that the flange 122 may thus protect the first surface 206 from damage and thereby leave the critical sealing location points (like the point A) untouched.

Figure 3:
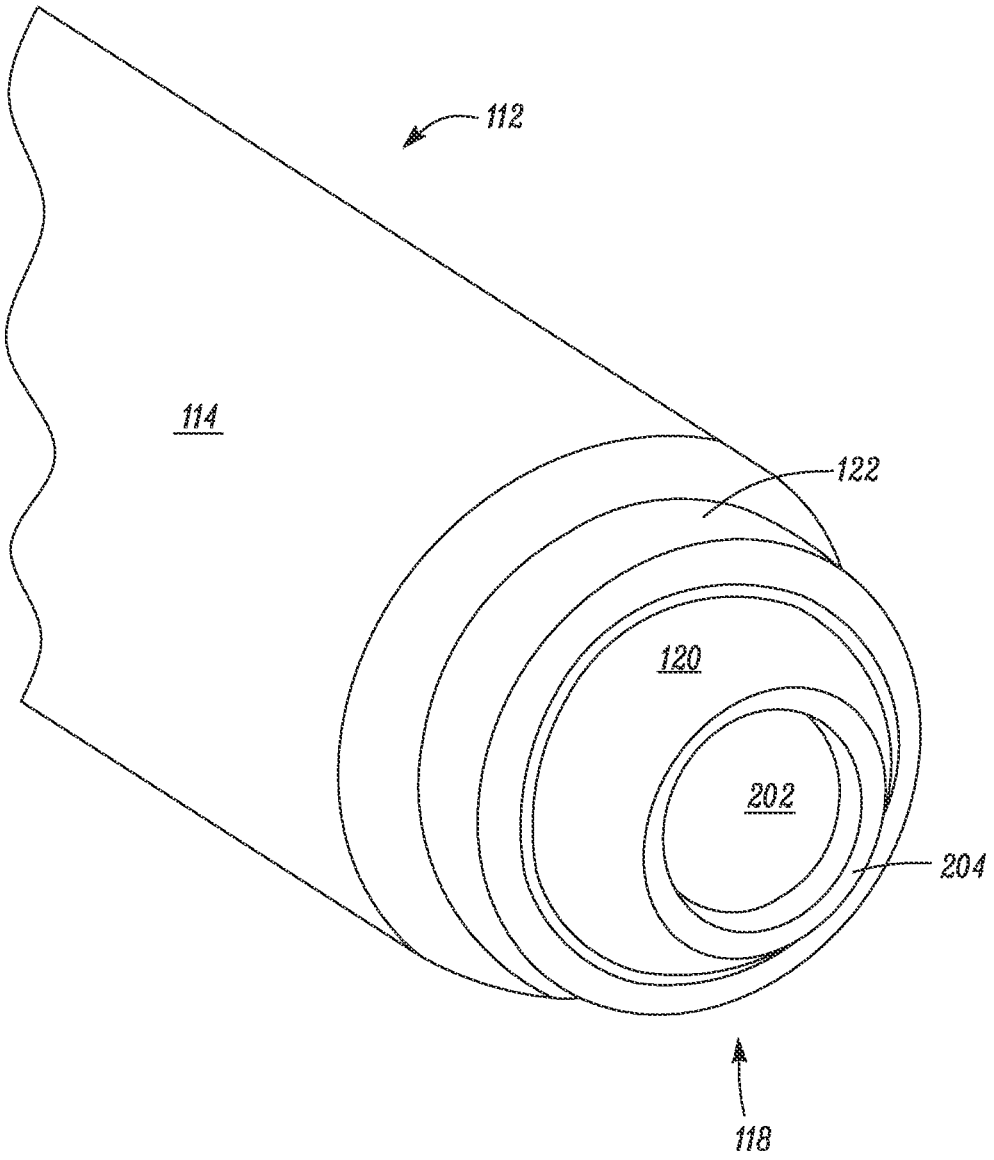
FIG. 3 is another view of the quill tube.

The flange 122 may be made of metal or any other suitable material. Moreover, in one embodiment, the flange 122 may be integrated with the quill tube 112. Alternatively, in another embodiment, the flange 122 may be detachably connected to the quill tube 112. FIGS. 2 and 3 depict different views of the quill tube 112. As is clearly visible, the flange 122 may form a circular surface surrounding the spherical head 120 of the quill tube 112. Referring to FIG. 2, the angular positioning of the flange 122 relative to the first surface 206 is such that on dragging the quill tube 112 against the external surface LL, the flange may cause external surface LL to be substantially tangential with respect to the spherical head 120 at the damage location points (for example, the point B) lying within the second surface 208. The second surface 208 lies on an inner side of the first surface 206 which contains the sealing location points, like the point A. As can be seen in FIG. 2, the first surface 206 does not touch or come in contact with the external surface LL, thereby protecting the first surface 206 from damage.

It should be noted that the size of the flange 122 may be based on the application and dimensions of the spherical head 120 and/or the conical cavity of the fuel injector 106. For example, if a height "H" of the flange 122 is decreased or the flange 122 is moved away from the tip 204, the damage location points lying within the second surface 208 may lie relatively closer to the sealing location points of the first surface 206. Conversely, in another example, if the height "H" of the flange 122 is increased or the flange 122 is moved closer towards the tip 204, the damage location points lying within second surface 208 may move further away from the first surface 206 and closer towards the tip 204. Also, the height "H" of the flange 122 may need to be optimized so that on installation within the fuel injector 106, the flange 122 does not hit the fuel injector 106 or any other surface within the cylinder head 104. Hence, the height "H" and placement of the flange 122 may be such that the flange 122 is as close to the tip 204 as possible, without interfering with the sealing of the quill tube 112 within the fuel injector 106.

Figure 4:
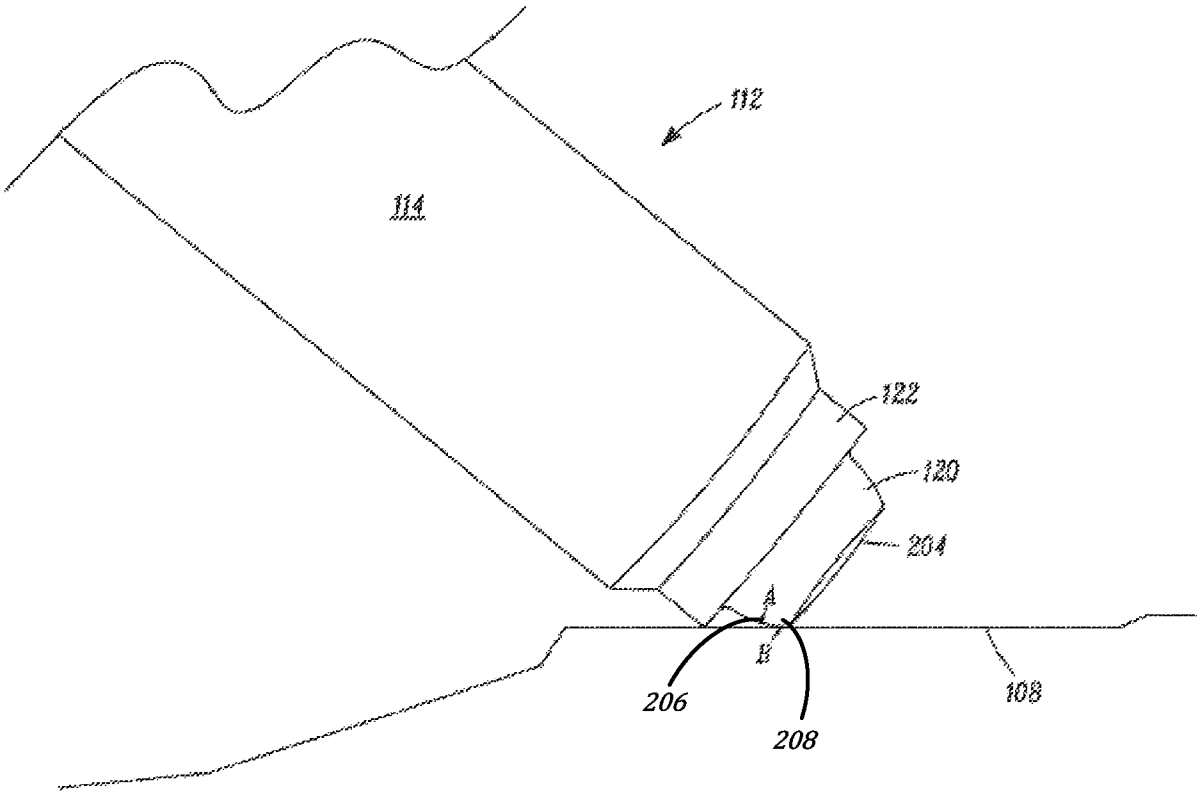
FIG. 4 is a diagrammatic view of the quill tube and an external surface.
Figure 5:
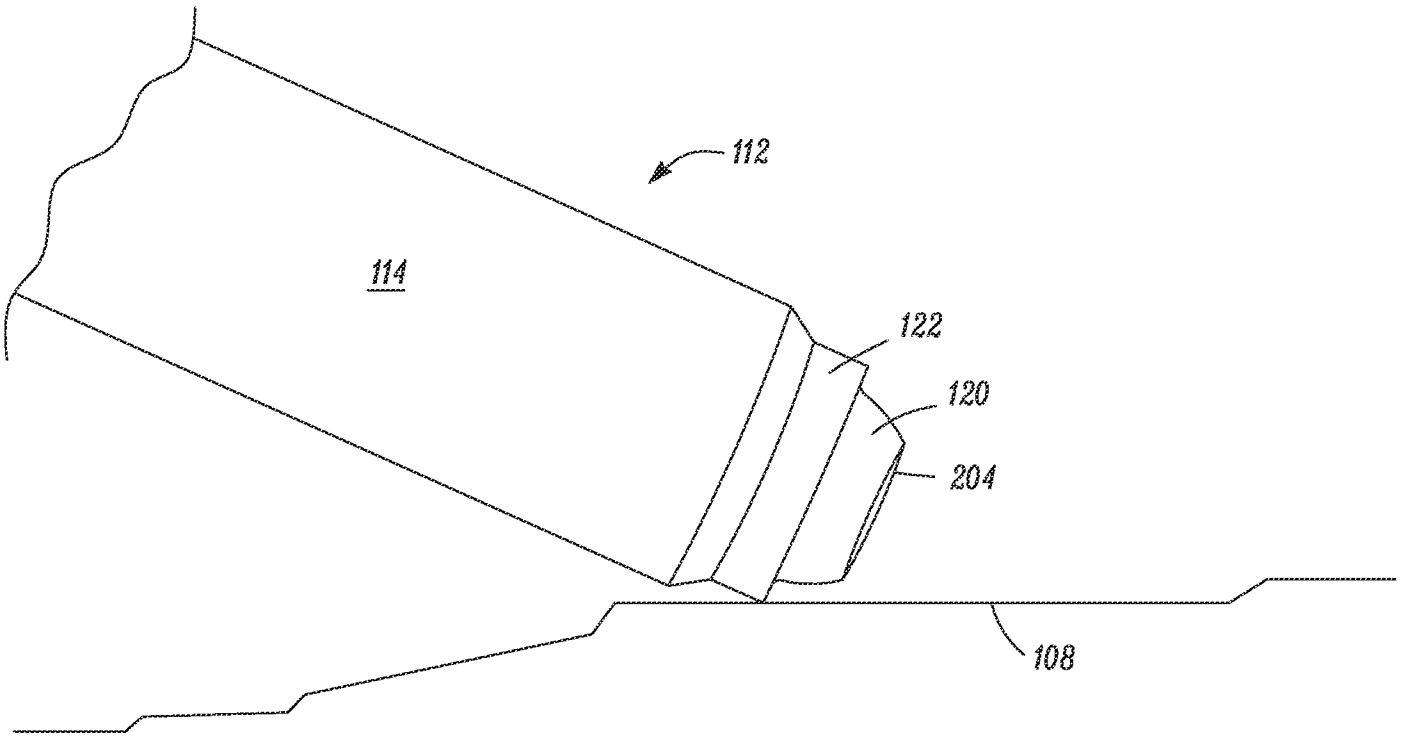
FIG. 5 is another diagrammatic view of the quill tube and the external surface.

FIGS. 4 and 5 depict two different exemplary scenarios during installation of the quill tube 112 into the cavity 110 of the cylinder head 104. FIG. 4 illustrates one case wherein an inclination of the quill tube 112 within the cavity 110 is such that both the flange 122 and the spherical head 120 of the quill tube 112 may contact the inner surface 108 of the cylinder head 104. Referring to FIG. 4, the positioning of the flange 122 is such that the flange 122 may cause the second surface 208 (more specifically the point B) of the spherical head 120 to touch the inner surface 108. In another case, when the inclination of the quill tube 112 relative to the inner surface 108 is as shown in FIG. 5, the flange 122 may prevent the spherical head 120 to come in contact with the inner surface 108. Thus, the flange 122 may protect the first surface 206 (represented as the point A) of the quill tube 112 by either preventing complete contact of the spherical head 120 with the external surface LL or by causing the second surface 208 to act as a sacrificial surface in order to protect the first surface 206, as the case maybe.

INDUSTRIAL APPLICABILITY

Quill tubes require having very good surface quality, such as, roundness and surface finish in order to seal high-pressure fuel. The quill tubes typically have an exposed spherical head, which may have a tendency to get damaged during manufacturing, transport or installation. During installation of the quill tube 112, the quill tube 112 may be contacted against the external surface LL. As described above, in the present disclosure, the flange 122 may protect the first surface 206 of the spherical head 120 from contacting the external surface LL. Hence, either the flange 122 or a combination of the flange 122 and the second surface 206 may act as sacrificial surfaces in damage causing situations. The positioning of the flange 122 may cause the second surface 206 to contact the external surface LL. Moreover, in such situations, the first surface 206, which lies between the second surface 208 and the flange 122, may not come in contact with the external surface LL. Thus, the first surface 206 may be protected from damage. It should be noted that the quill tube 112 shown the accompanied figures is merely on an exemplary basis. The flange 122 may be provided on any other quill tube having the spherical head 120.

Although the embodiments of this disclosure as described herein may be incorporated without departing from the scope of the following claims, it will be apparent to those skilled in the art that various modifications and variations can be made. Other embodiments will be apparent to those skilled in the art from consideration of the specification and practice of the disclosure. It is intended that the specification and examples be considered as exemplary only, with a true scope being indicated by the following claims and their equivalents.

What is claimed is:

1. A quill tube for a fuel delivery system, the quill tube comprising:
- a hollow body defining a bore within the quill tube, the bore configured to direct a flow of fuel into a fuel injector;
- a spherical head located at a first end of the hollow body, the spherical head including:
  - a tip located at a distal end of the spherical head;
  - a first surface configured to engage with the fuel injector and defining a plurality of sealing points; and
  - a second surface positioned between the tip and the first surface and defining a plurality of damage location points; and
- a flange located proximate to the spherical head, the flange angularly positioned relative to the first surface, wherein if the spherical head is contacted against an external surface, the flange is configured to cause the second surface to touch the external surface, wherein the flange has a height H relative to the spherical head, the height H configured such that if H is decreased, then a distance between the plurality of damage location points and the plurality of sealing points is decreased, and wherein the height H is configured such that if H is increased, then the distance between the plurality of damage location points and the plurality of sealing points is increased.

2. The quill tube of claim 1, wherein the flange is made of metal.

3. The quill tube of claim 1, wherein the flange is integrated with the quill tube.

4. The quill tube of claim 1, wherein the external surface includes an inner surface of an engine head.

5. The quill tube of claim 4, wherein the external surface has a flat configuration.

6. A system comprising:
- an engine head including an inner surface defining a cavity;
- a fuel injector located at a distal end of the cavity; and
- a quill tube configured to be movable in an axial direction within the cavity, the quill tube including:
  - a hollow body defining a bore within the quill tube, the bore configured to direct a flow of fuel into the fuel injector;
  - a spherical head located at a first end of the hollow body, the spherical head including:
    - a tip located at a distal end of the spherical head;

a first surface configured to engage with the fuel injector and defining a plurality of sealing points; and a second surface positioned between the tip and the first surface and defining a plurality of damage location points; and a flange located proximate to the spherical head, the flange angularly positioned relative to the first surface, wherein if the spherical head is contacted against the inner surface during the movement, the flange is configured to cause the second surface to touch the inner surface, wherein the flange has a height H relative to the spherical head, the height H configured such that if H is decreased, then a distance between the plurality of damage location points and the plurality of sealing points is decreased, and wherein the height H is configured such that if H is increased, then the distance between the plurality of damage location points and the plurality of sealing points is increased.

7. The system of claim 6, wherein the flange is made of metal.

8. The system of claim 6, wherein the flange is integrated with the quill tube.

9. The system of claim 6, wherein the inner surface has a flat configuration.

* * * * *